US006062615A

United States Patent [19]

Hunt et al.

[11] Patent Number: 6,062,615

[45] Date of Patent: May 16, 2000

[54] ACTUATING ASSEMBLY FOR MOTOR-VEHICLE DOOR LATCH

[75] Inventors: Robert Hunt, Davisburg; Raja Raymond, Clarkston, both of Mich.; Claus Töpfer, Sindelfingen, Germany

[73] Assignee: Kiekert AG, Heiligenhaus, Germany

[21] Appl. No.: 09/156,529

[22] Filed: Sep. 17, 1998

[51] Int. Cl.[7] ..... E05B 3/00

[52] U.S. Cl. ..... 292/336.3; 292/216; 74/528; 74/543; 74/545; 74/547; 74/501.6

[58] Field of Search ..... 292/336.3, DIG. 31, 292/347, 216; 74/528, 543, 545, 547, 557, 501.6, 500.5, 501.5 R, 551.3, 523, 529

[56] References Cited

U.S. PATENT DOCUMENTS

| | | | |
|---|---|---|---|
| 3,606,428 | 9/1971 | Erck et al. | 292/336.3 |
| 4,889,373 | 12/1989 | Ward et al. | 292/336.3 |
| 4,929,007 | 5/1990 | Bartczak et al. | 292/336.3 |
| 4,993,763 | 2/1991 | Tanimoto et al. | 292/336.3 |
| 5,011,202 | 4/1991 | Kato et al. | 292/DIG. 31 |
| 5,427,421 | 6/1995 | Hamaguchi | 292/216 |

*Primary Examiner*—Teri Pham
*Attorney, Agent, or Firm*—Herbert Dubno; Andrew Wilford

[57] ABSTRACT

A motor-vehicle door latch has an element displaceable between a locked position and an unlocked position and a bowden cable has one end connected to the element and an opposite end. A latch-actuating assembly has a housing, a main lever pivoted on the housing about a main axis between an actuated position and an unactuated position and formed offset from the main axis with an entrainment formation, and a secondary lever pivoted about a secondary axis and having an attachment point offset from both axes and connected to the bowden cable. Thus the secondary lever pivots about the secondary axis relative to the main lever synchronously with the element between locked and unlocked positions. The secondary lever is formed with an entrainment formation engageable in the unlocked position with the main-lever entrainment formation on movement of the main lever from the unactuated into the actuated position and is unengageable in the locked position with the main-lever entrainment formation on movement of the main lever from the unactuated to the actuated position. The secondary axis is on the main lever and is offset from the main axis.

7 Claims, 5 Drawing Sheets

ACTUATING ASSEMBLY FOR MOTOR-VEHICLE DOOR LATCH

FIELD OF THE INVENTION

The present invention relates to a motor-vehicle door latch. More particularly this invention concerns an actuating assembly for such a latch.

BACKGROUND OF THE INVENTION

A standard door latch has a locking element displaceable between a locked position and an unlocked position and a bowden cable having one end connected to the element and an opposite end. Normally the locking element serves in an unlocked position to couple an actuating lever to a pawl. The pawl in turn serves to retain a latching fork that can engage around a bolt to hold the door closed. Thus in the unlocked position actuation of the actuating lever, for instance by a door handle, serves to pull the pawl off the fork and release the bolt, unlatching the door. In the locked position the locking element decouples the actuating lever from the pawl so that, even if it is actuated, the door stays latched.

The inside locking mechanism is typically a lever connected through the bowden to the locking element and actuating lever. When the element is in the unlocked position, operation of the inside actuating assembly, typically by pivoting a handle thereof, operates the actuation lever to unlatch the door.

In order to render the inside actuating assembly ineffective in the locked position of the locking element as defined in commonly owned U.S. Pat. No. 5,681,068 there is a link mechanism between two parts of the actuating assembly. In the unlocked position the link mechanism couples the two parts together and in the unlocked position it decouples them, much like the way it couples and decouples the actuating lever and pawl in the latch itself.

While such a system is fairly effective, it represents extra moving parts that can fail and that raise the cost of the actuating assembly.

OBJECTS OF THE INVENTION

It is therefore an object of the present invention to provide an improved actuating assembly for a motor-vehicle door latch.

Another object is the provision of such an improved actuating assembly for a motor-vehicle door latch which overcomes the above-given disadvantages, that is which is substantially simpler than the known such actuating assemblies.

SUMMARY OF THE INVENTION

A motor-vehicle door latch has an element displaceable between a locked position and an unlocked position and a bowden cable has one end connected to the element and an opposite end. A latch-actuating assembly has according to the invention a housing, a main lever pivoted on the housing about a main axis between an actuated position and an unactuated position and formed offset from the main axis with an entrainment formation, and a secondary lever pivoted about a secondary axis and having an attachment point offset from both axes and connected to the bowden cable. Thus the secondary lever pivots about the secondary axis relative to the main lever synchronously with the element between locked and unlocked positions. The secondary lever is formed with an entrainment formation engageable in the unlocked position with the main-lever entrainment formation on movement of the main lever from the unactuated into the actuated position and is unengageable in the locked position with the main-lever entrainment formation on movement of the main lever from the unactuated to the actuated position. According to the invention the secondary axis is on the main lever and is offset from the main axis.

Thus this system has no moving parts and functions in a very sure and simple manner. It decouples the levers from each other when the locking element of the latch is moved into the locked position so that operation of the main lever will not pivot the secondary lever, but when the locking lever is in the unlocked position, the entrainment formations will engage each other and couple the two levers together. Once the two formations are engaged with each other, the force necessary to pivot the levers is constant.

The main lever in accordance with the invention is generally C-shaped and has one end forming the respective entrainment formation. Furthermore the secondary-lever entrainment formation is a wedge-shaped nose directed angularly of the secondary axis. Since the two parts engage each other radially and do not move relative to each other once engaged, the system will not wear appreciably and can therefore be counted on to have a long service life. The main lever is formed with a cavity receiving the secondary lever and the secondary lever is formed with an arm extending radially of the secondary axis and forming the attachment point. Thus the system is quite compact and easy to install as the inside operating handle of a motor-vehicle door.

For smoothest action the axes and attachment point are generally equispaced and form a generally equilateral triangle. In addition the main lever is formed with a handle extending generally radially of the main axis.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
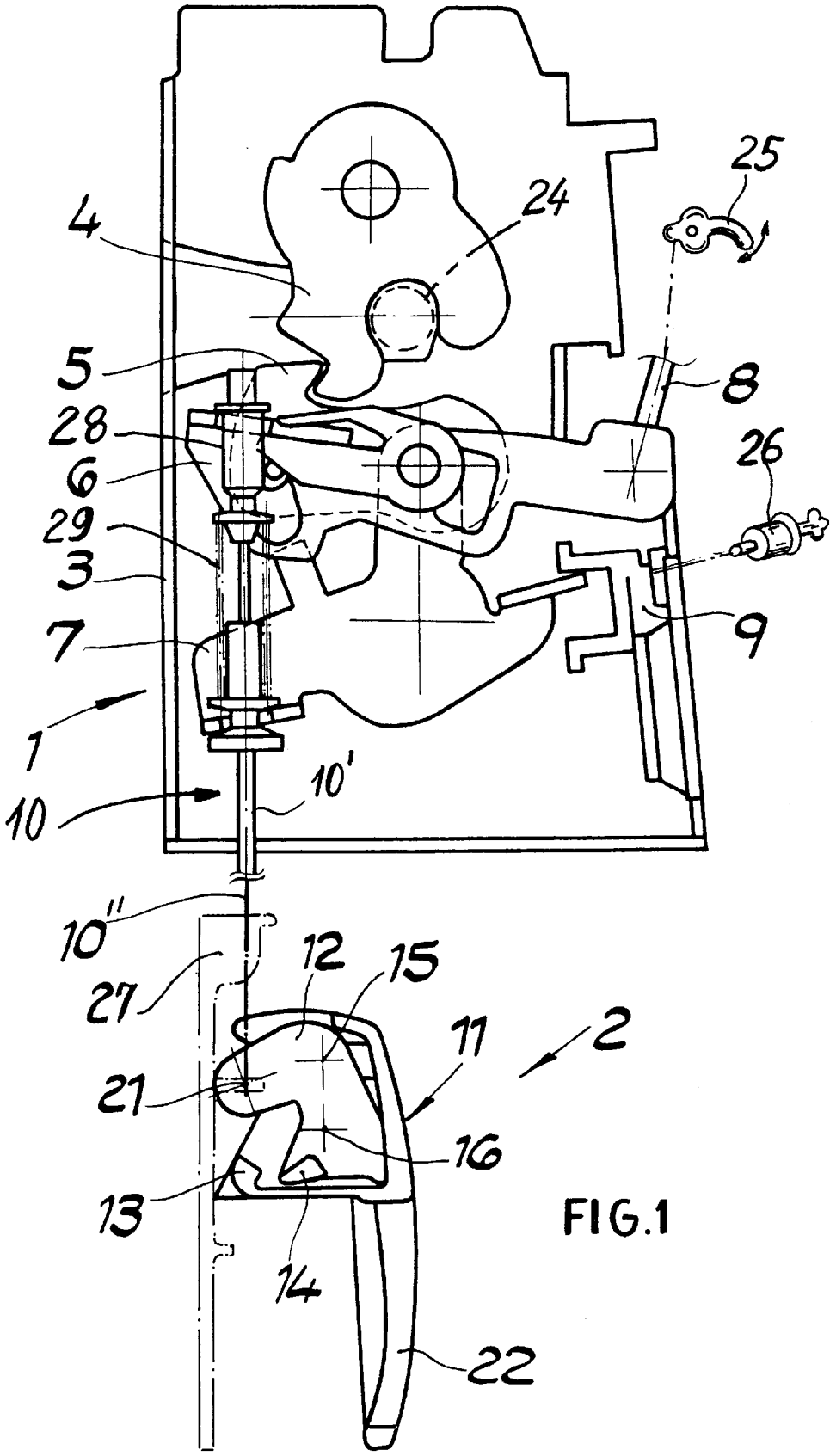
FIG. 1 is a partly diagrammatic side view of a motor-vehicle door latch and its actuating assembly according to the invention.

As seen in FIG. 1 a motor-vehicle door latch 1 is operated by an actuating assembly or mechanism 2. The latch 1 has a housing 3 normally mounted on the edge of a motor-vehicle door and carrying a pivotal fork 4 that can engage around a bolt 24 projecting from the adjacent door post. A standard pawl 5 can retain the fork 4 in the illustrated holding position in which it retains the bolt 24. A locking lever 7 can pivot on the housing 3 between the illustrated unlocked position and, offset clockwise therefrom, an unillustrated locked position to couple an actuating lever 6 with the pawl 5. In the unlocked position, pivoting of the actuating lever 6, for instance by means of a handle 25 effective through a link rod 8, is ineffective to operate the pawl 5 and release the bolt 24 from the lever 4. An outside lock cylinder 26 is effective through a slider 9 on the lever 7 to displace it between the locked and unlocked positions.

In the illustrated arrangement, which operates similarly to that of above-cited U.S. Pat. No. 5,681,068, a bowden cable 10 extends between the latch 1 and actuating mechanism 2. More specifically, its sleeve 101 is braced at one end against a housing 27 of the mechanism 2 and at its opposite end against an end of the locking lever 7. Its core 10" has one end fixed in a collar 28 engageable with the actuating lever 6 and biased by a spring 29 away from the lever 7 and an opposite end pivoted at 21 in the mechanism 2. There is sufficient slack in the cable 10 that, when the lever 7 is pivoted clockwise from the illustrated unlocked position to the to the locked position, this action moves the collar 28 so far from the lever 6 that even if the core 10" is retracted into the sleeve 10' this motion will not be transmitted to the lever 6 to open the latch 1.

Figure 2:
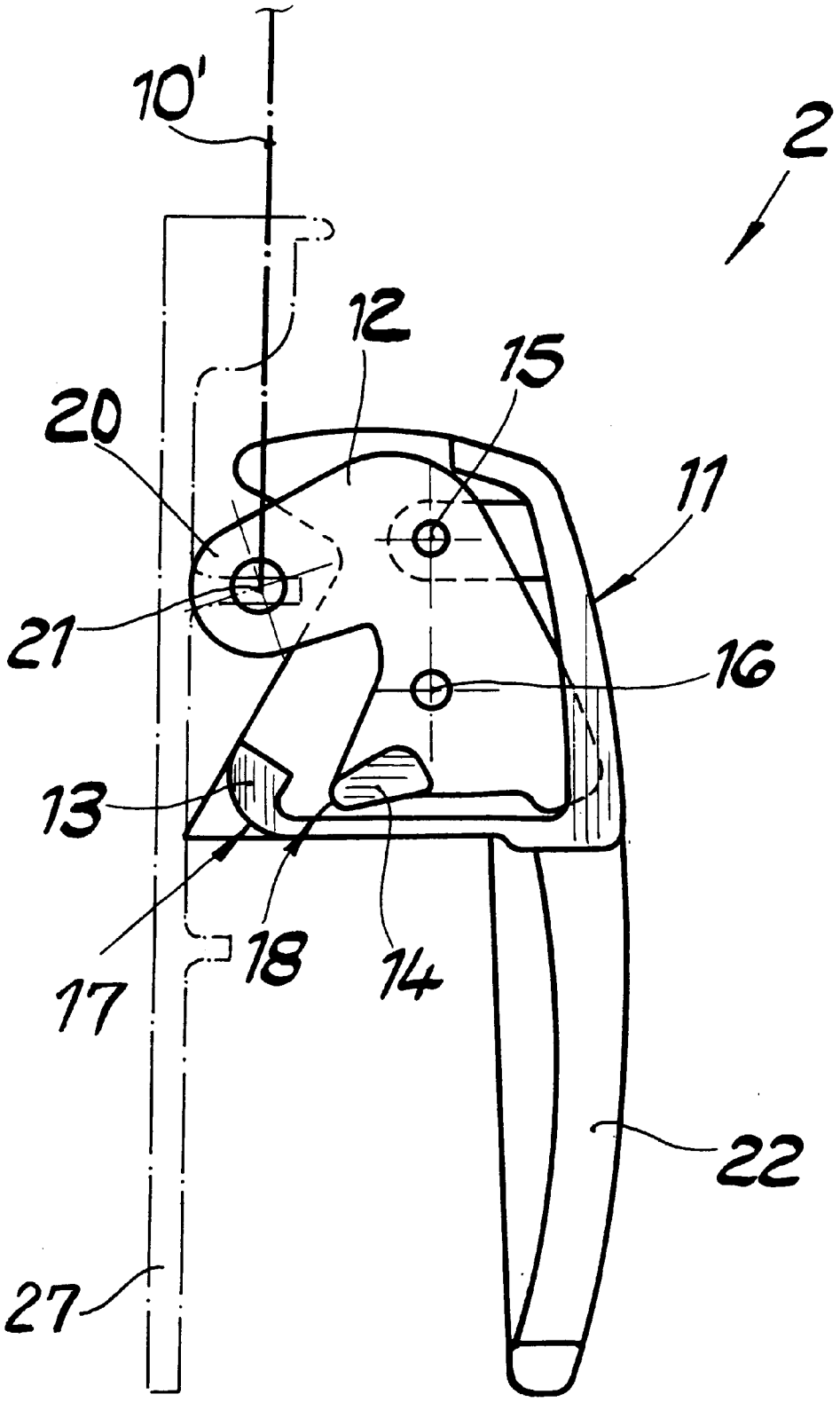
FIG. 2 is a larger-scale side view of the actuating assembly in accordance with the invention.

According to the invention the mechanism 2, which is best shown in FIG. 2, comprises an outside lever or element 11 and an inside lever or element 12 in a cavity 19 (FIG. 3) of the outside lever 11. The outside lever 11 is pivoted at 15 on the housing 27 and the inside lever 12 is pivoted at 16, which is offset from the pivot 15, on the lever 11. The lever 12 has an arm 20 formed with the attachment point 21 for the bowden core 10'. The pivots 15 and 16 and the attachment point 21 form a generally equilateral triangle. The levers 11 and 12 are formed with abutments or engagement formations 17 and 18 here constituted as a hook 13 formed on the lever 11 and a nose 14 on the lever 12. The lever 11 has a handle 22 allowing it to be pivoted about its axis 15.

Figure 3:
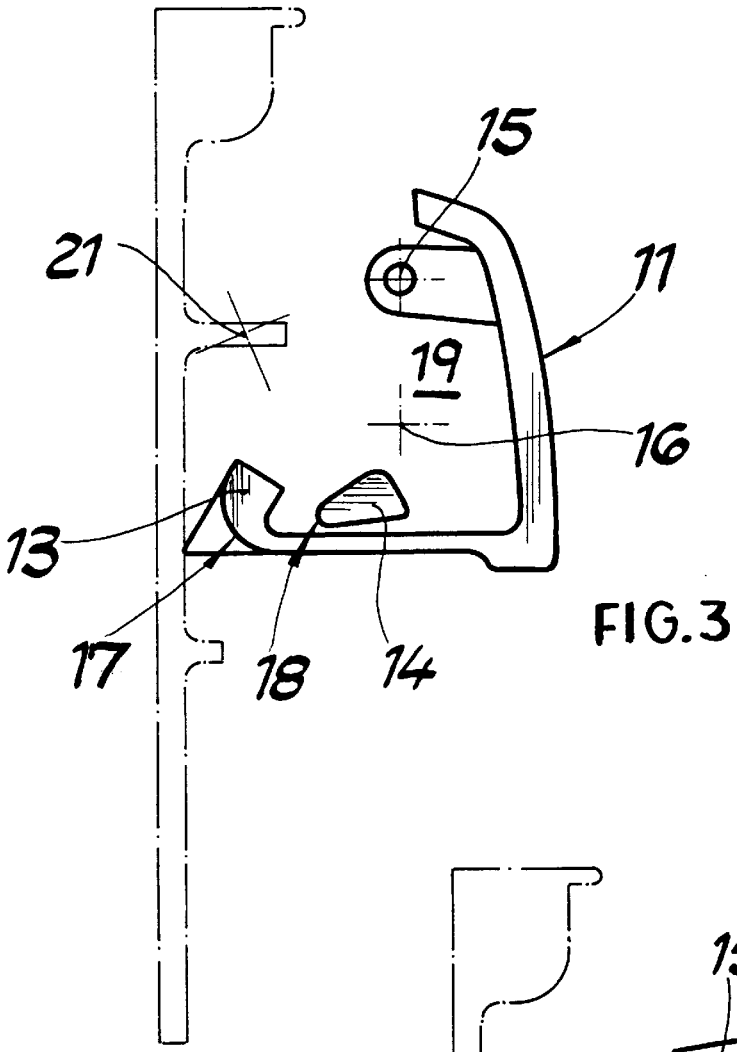
FIGS. 3 and 4 are diagrammatic views illustrating the actuating assembly with the latch unlocked and in the unactuated and actuated positions, respectively.

When the lever 7 is in the illustrated unlocked position the bowden 10 will hold the inside lever 12 in the position shown in FIGS. 2 and 3. When in this position as illustrated in FIG. 4 pivoting of the lever 11 about its axis 15 will cause the part 18 to hook on the part 17 so that the lever 11 will entrain the lever 12, thereby operating the actuating lever 6 to unlatch the door.

Figure 4:
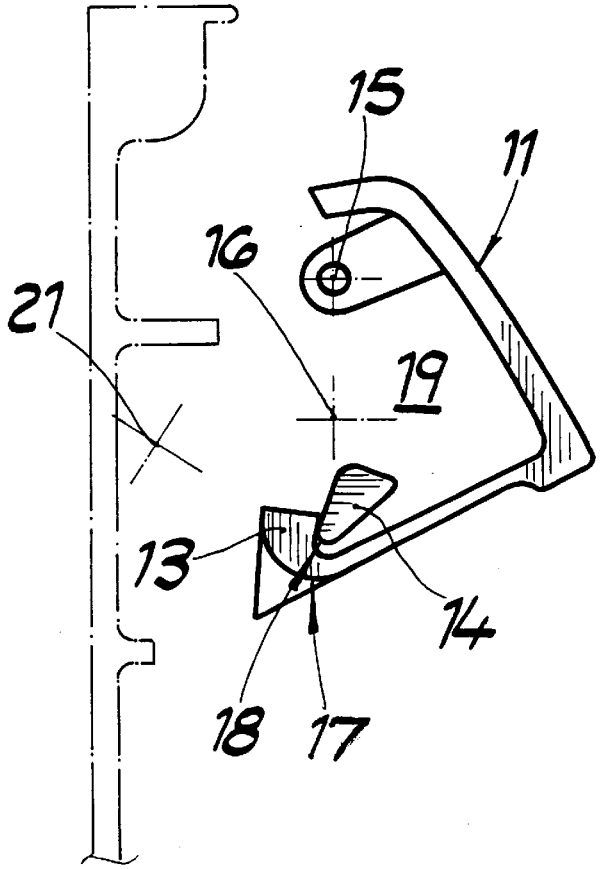
Figure 5:
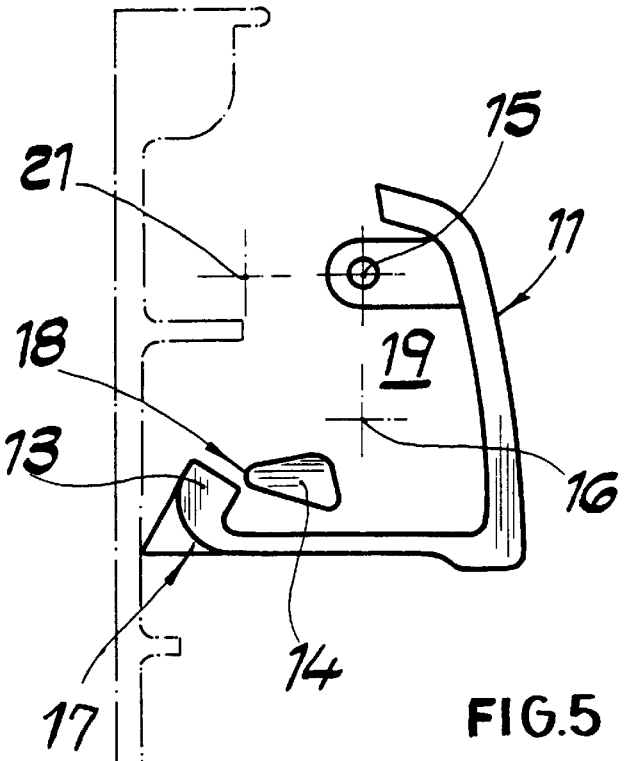
FIGS. 5 and 6 are views like respective FIGS. 3 and 4 but with the latch in the locked position.
Figure 6:
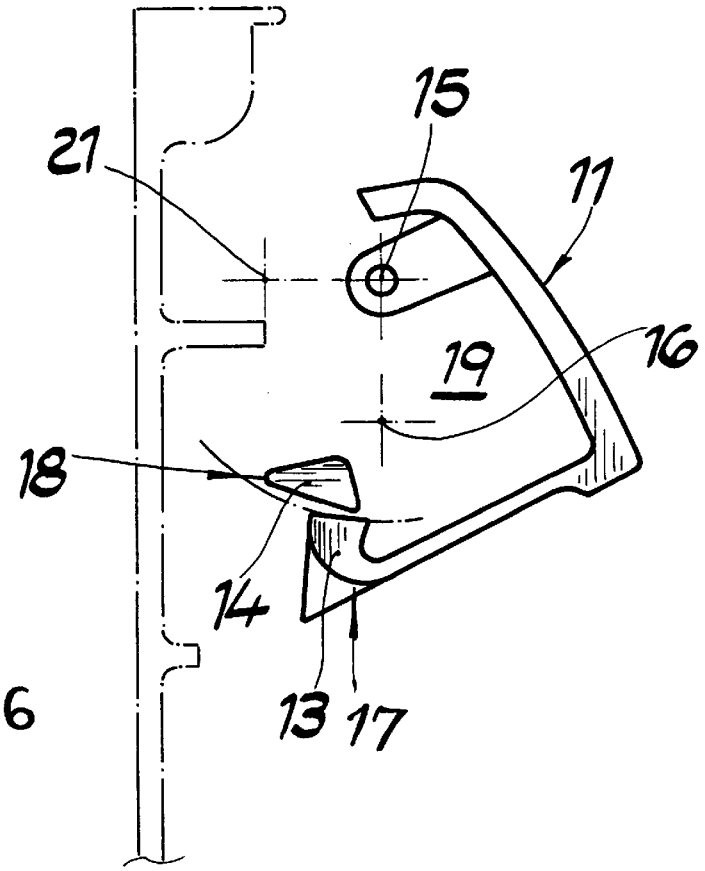
Figure 7:
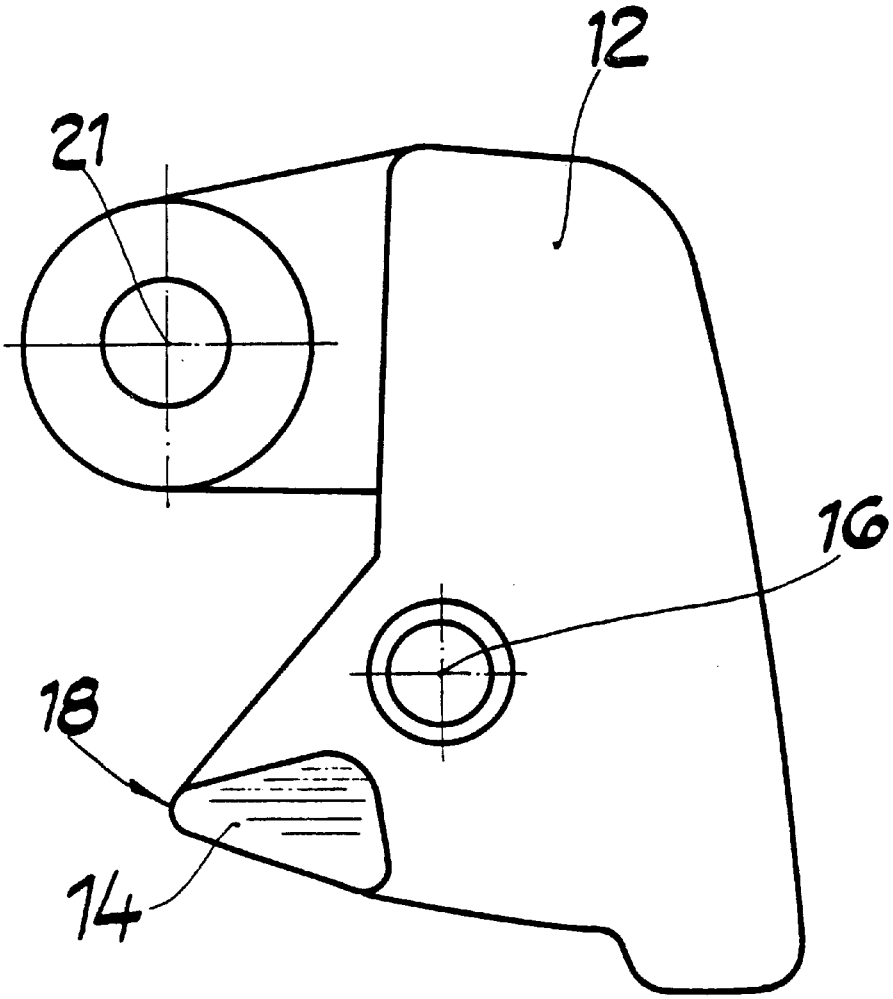
FIG. 7 is a large-scale view of the locking element of the actuating assembly.

In the locked position the lever 12 will be pivoted somewhat clockwise from the position of FIGS. 3 and 4 so that, when the lever 11 is pivoted as shown in FIGS. 5 and 6, the formation 17 will pass by the formation 18, preventing any actuation of the bowden 10 by the mechanism 2. Thus in this locked position the inside door-operating mechanism will be ineffective.

We claim:

1. In combination with a motor-vehicle door latch having an element displaceable between a locked position and an unlocked position and with a bowden cable having one end connected to the element and an opposite end, a latch-actuating assembly comprising:

a housing;

a main lever pivoted on the housing about a main axis between an actuated position and an unactuated position and formed offset from the main axis with an entrainment formation;

a secondary lever pivoted on the main lever offset from the main axis about a secondary axis and having an attachment point offset from both axes and connected to the opposite end of the bowden cable, whereby the secondary lever pivots about the secondary axis relative to the main lever synchronously with the element between locked and unlocked positions; and another entrainment formation formed on the secondary lever offset from the axes, the axes being offset from each other such that the secondary-lever entrainment formation is engageable in the unlocked position with the main-lever entrainment formation on movement of the main lever from the unactuated into the actuated position for coupling the main lever to the element and the secondary-lever entrainment formation is unengageable in the locked position with the main-lever entrainment formation and instead moves past the main-lever entrainment formation on movement of the main lever from the unactuated to the actuated position for decoupling the main lever from the element.

2. The latch-actuating assembly defined in claim 1 wherein the main lever is generally C-shaped and has one end forming the respective entrainment formation.

3. The latch-actuating assembly defined in claim 1 wherein the secondary lever is formed with an arm extending radially of the secondary axis and forming the attachment point.

4. The latch-actuating assembly defined in claim 1 wherein the axes and attachment point are generally equispaced and form a generally equilateral triangle.

5. The latch-actuating assembly defined in claim 1 wherein the main lever is formed with a handle extending generally radially of the main axis.

6. In combination with a motor-vehicle door latch having an element displaceable between a locked position and an unlocked position and with a bowden cable having one end connected to the element and an opposite end, a latch-actuating assembly comprising:

a housing;

a generally C-shaped main lever pivoted on the housing about a main axis between an actuated position and an unactuated position and having one end formed offset from the main axis with an entrainment formation;

a secondary lever pivoted on the main lever offset from the main axis about a secondary axis and having an attachment point offset from both axes and connected to the opposite end of the bowden cable, whereby the secondary lever pivots about the secondary axis relative to the main lever synchronously with the element between locked and unlocked positions; and means including another entrainment formation formed on the secondary lever offset from the axes for engagement in the unlocked position with the main-lever entrainment formation on movement of the main lever from the unactuated into the actuated position and for coupling the main lever to the element and for movement in the locked position past the main-lever entrainment formation on movement of the main lever from the unactuated to the actuated position for decoupling the main lever from the element, the secondary-lever entrainment formation being a wedge-shaped nose directed angularly of the secondary axis.

7. In combination with a motor-vehicle door latch having an element displaceable between a locked position and an unlocked position and with a bowden cable having one end connected to the element and an opposite end, a latch-actuating assembly comprising:

a housing;

a main lever pivoted on the housing about a main axis between an actuated position and an unactuated position and formed offset from the main axis with an entrainment formation;

a secondary lever pivoted on the main lever offset from the main axis about a secondary axis and having an attachment point offset from both axes and connected to the opposite end of the bowden cable, whereby the secondary lever pivots about the secondary axis relative to the main lever synchronously with the element between locked and unlocked positions, the main lever being formed with a cavity receiving the secondary lever; and means including another entrainment formation formed on the secondary lever offset from the axes for engagement in the unlocked position with the main-lever entrainment formation on movement of the main lever from the unactuated into the actuated position and for coupling the main lever to the element and for movement in the locked position past the main-lever entrainment formation on movement of the main lever from the unactuated to the actuated position for decoupling the main lever from the element.

* * * * *